United States Patent [19]

Wierzba et al.

[11] Patent Number: 4,639,381

[45] Date of Patent: Jan. 27, 1987

[54] METHOD FOR REDUCING FIRESIDE TUBE DEPOSITION AND BOILER SOOTBLOWING REQUIREMENTS

[75] Inventors: Robert B. Wierzba, Bridgeview; Robert G. Snyder, Palos Heights; Blaise H. Kleefisch, Riverdale, all of Ill.

[73] Assignee: Nalco Chemical Company, Oak Brook, Ill.

[21] Appl. No.: 746,378

[22] Filed: Jun. 19, 1985

Related U.S. Application Data

[62] Division of Ser. No. 533,568, Sep. 19, 1983, Pat. No. 4,545,411.

[51] Int. Cl.[4] ..... B05D 1/12

[52] U.S. Cl. ..... 427/156; 427/181; 427/230; 427/236; 134/2; 134/22.13; 165/95

[58] Field of Search ..... 427/156, 181, 230, 236; 134/2, 22.13; 165/95

[56] References Cited

U.S. PATENT DOCUMENTS

| | | | |
|---|---|---|---|
| 1,607,554 | 11/1926 | Meyer | 427/181 |
| 3,593,781 | 7/1971 | Fransman | 165/95 |
| 4,240,472 | 12/1980 | Sriniuas | 141/59 |
| 4,366,855 | 1/1983 | Spitz | 165/95 |
| 4,456,635 | 6/1984 | Albanese et al. | 427/230 |

FOREIGN PATENT DOCUMENTS

| | | | |
|---|---|---|---|
| 820989 | 9/1959 | United Kingdom | 134/22.13 |

OTHER PUBLICATIONS

Nalco-152, Slag Control Treatment, Nalco Chem. Co., Oak Brook, Illinois, 1 page, 6/1975.

Nalco-156-C, Slag Control Agent For Boilers, Kilns, Incinerators, Nalco Chem. Co., Oak Brook, Illinois, 1 page, 1/1980.

*Primary Examiner*—Shrive P. Beck

*Attorney, Agent, or Firm*—Lloyd L. Zickert; John G. Premo

[57] ABSTRACT

Method and apparatus for reducing the sootblowing requirements for boiler heat exchanger tubes which also reduces boiler downtime and production losses as well as energy requirements. The method involves the steps of programming the feeding of chemicals to the boiler in timed relation to a sootblowing cycle to establish a cleavage plane on the tube surfaces. The apparatus includes the feeding of a measured amount of powdered chemicals to the boiler following each sootblowing operation, which includes a storage vessel charged with a measured amount of chemical that is emptied during a chemical application cycle.

3 Claims, 7 Drawing Figures

METHOD FOR REDUCING FIRESIDE TUBE DEPOSITION AND BOILER SOOTBLOWING REQUIREMENTS

This application is a division of our co-pending application Ser. No. 533,568, filed Sept. 19, 1983, now U.S. Pat. No. 4,545,411, issued Oct. 8, 1985.

This invention relates in general to a method and apparatus for feeding powdered material to a boiler or furnace to materially increase the efficiency of the boiler or furnace, and more particularly to a method and apparatus for reducing the sootblowing requirements of boiler heat exchanger tubes that includes feeding of measured amounts of powdered material to the boiler in timed relation to the sootblowing operations, and still more particularly to a method and apparatus for reducing the sootblowing requirements in a recovery boiler of a kraft pulp and paper mill.

During the operation of the solid fuel fired boiler or furnace, and particularly a recovery boiler used in a typical kraft pulp and paper mill, deposits form on the fireside surfaces of heat exchanger tubes. Various operating parameters affect the cleanliness of the heat exchanger tube surfaces. Further, the chemical properties of the impinging material have a direct bearing on deposit formation. For example, in a kraft recovery boiler the degree of concentration of liquor solids, presence of chlorides in the liquor, and the presence of lowfusion temperature salts may cause excessive troublesome deposits.

The deposit formation tends to close spaces between the tubes which in turn may result in superheat temperature drop, draft loss increase, fan amperage increase, steam production losses and other boiler operating losses, all of which result in production losses for the boiler. When the losses and problems reach a certain point, the boiler or furnace is usually taken off-line for fireside water washing, hand-lancing or other cleaning techniques. Production losses are experienced when the boiler or furnace is down and maintenance costs are substantial to place the boiler back into condition for further operation.

The most heretofore known universal method of deposit formation control and deposit removal has been the use of soot blowers. Most kraft recovery furnaces are equipped with a battery of soot blowers that are often paired and operated by an automated sootblowing cycle that fires each pair sequentially upon completion of the furnace traverse of a previous pair. When the last pair of the entire battery completes its travels, the system generally recycles the first pair immediately. Steam is employed for the soot blowers for loosening and removing deposit formations. With constant cycling of the soot blowers, steam is being used for the sootblowing operation on a 24-hour basis.

In kraft recovery boilers, deposit control has generally been satisfactory where there is provided a proper number, sizing, spacing and cycling of soot blowers especially when liquor flow was at or near the furnace design rating. The energy costs for sootblowing, dictated mainly by the amount of steam needed to operate the soot blowers efficiently, is substantial.

While sootblowing cannot be eliminated, optimization of the sootblowing process may offer significant energy savings in systems not being subjected to excess rated capacity. Therefore, reduction of sootblowing can materially improve the overall efficiency of a boiler or furnace.

The present invention reduces sootblowing requirements, thereby materially increasing the efficiency of the boiler or furnace utilizing a dry product specifically formulated for controlling boiler slag. A cleavage plane is established on the clean, just soot-blown tube surfaces which inhibits deposit formation, thereby increasing the time period before another sootblowing cycle is needed. An automated feed system according to the present invention reapplies the powdered product and reestablishes the deposit barrier after each sootblowing operation. Accordingly, the invention reduces boiler and sootblowing steam demand as well as boiler downtime, thereby decreasing energy and maintenance costs and minimizing boiler influenced product losses. The present invention reduces sootblowing up to fifty percent and increases boiler run lengths between outages. This results in substantial energy savings by enhancing sootblowing effectiveness which in turn increases mill profitability.

The apparatus of the present invention includes a pressure vessel into which a measured amount of powdered material for a feed cycle to the boiler is stored until a signal is given to feed the powdered material to the boiler following a sootblowing cycle. The vessel includes an outlet feeding to an air supply line that is connected to the boiler duct above the fire. A valve is interposed between the outlet of the vessel and the air supply line which, when opened, empties the vessel. In addition to the gravitational movement of the powder into the air supply line, a pressure line connected to the air supply line and pressurized by a check valve in the air supply line maintains a positive pressure in the vessel to assist in the discharge of its contents. Following the feed of the contents to the boiler, a subsequent charge of powdered material is metered to the vessel through an inlet. An inlet valve is opened to permit the metering of a measured amount of material to the vessel. The operation of the apparatus is accomplished by pneumatic power and controlled by a programmable relay which can be adjusted to suitably vary the measured amount in the vessel and the discharge of the material to the boiler. Cycling of the programmable relay follows a signal from the soot blower control at the end of a sootblowing operation so that the powdered material is immediately applied to the fireside surfaces of the heat exchanger tubes.

It is therefore an object of the present invention to provide a method and apparatus for reducing sootblowing requirements in a boiler or furnace which involves the application of a dry product to the sootblown heat exchanger surfaces to establish a cleavage plane that inhibits the formation of deposits.

Another object of the present invention is in the provision of a method and apparatus for reducing sootblowing requirements for boilers or furnaces which extends run lengths between outages, minimizes both boiler and soot blower steam demand, decreases maintenance costs, and minimizes or eliminates recovery boiler influenced production losses.

Other objects, features and advantages of the invention will be apparent from the following detailed disclosure, taken in conjunction with the accompanying sheets of drawings, wherein like reference numerals refer to like parts, in which.

While the method and apparatus of the present invention is generally disclosed for use in reducing sootblowing requirements of a recovery furnace in a kraft pulp and paper mill where injection of slag control chemicals into the furnace establishes a cleavage plane on the heat exchanger surfaces that inhibits deposit formation, it will be appreciated that it may be used for injecting powdered combustion catalysts into boilers or furnaces. The powdered materials are injected into the fireside of these solid fuel fired furnaces and boilers generally at a location above the fire. When used as a slag control system, the invention is preferably automated for operation in timed relation to each sootblowing cycle for reapplying the powdered product to the tube surfaces and reestablishing the barrier to deposit formation. While the system in the present invention is generally set up to begin its cycle of operation after the completion of firing of a soot blower, it may be appreciated that it also could be programmed to operate after the completion of any specific event.

The apparatus of the invention includes a superbag handling structure for purposes of handling superbags of dry powdered material which may weigh at least one thousand pounds. The superbag is mounted on a structure for gravitationally dumping its contents into a hopper, at the bottom of which is disposed a metering auger that on command feeds a measured amount of material to its discharge outlet which is connected to a low pressure vessel through a butterfly valve. The valve is opened during a filling operation of the vessel and thereafter closed. At the outlet end of the pressure vessel, an outlet valve controls the feeding of the contents of the vessel to an air supply line that is connected to the duct structure of the boiler above the fire. A check valve is disposed ahead of the point where the vessel outlet connects to the air supply line for purposes of feeding a part of the pressure in the air supply line upward through a lead line to the pressure vessel and thereby placing the pressure vessel under a low pressure condition which enhances the discharge of the contents when the outlet valve is opened. Electrical and pneumatic controls sequentially cycle the operation of the air supply line, the inlet and outlet valves to the pressure vessel and the metering auger to sequentially cycle the operation of the apparatus through a vessel emptying and a vessel filling operation, thereby accomplishing a feed cycle of a measured amount of dry product or powdered material to the boiler. The air supply line operates as a pneumatic conveyer in delivering the powdered material from the pressure vessel to the boiler. A programmable relay controls the operation of the apparatus and may be adjusted to vary the amount of measured material used for a single cycle.

Figure 1:
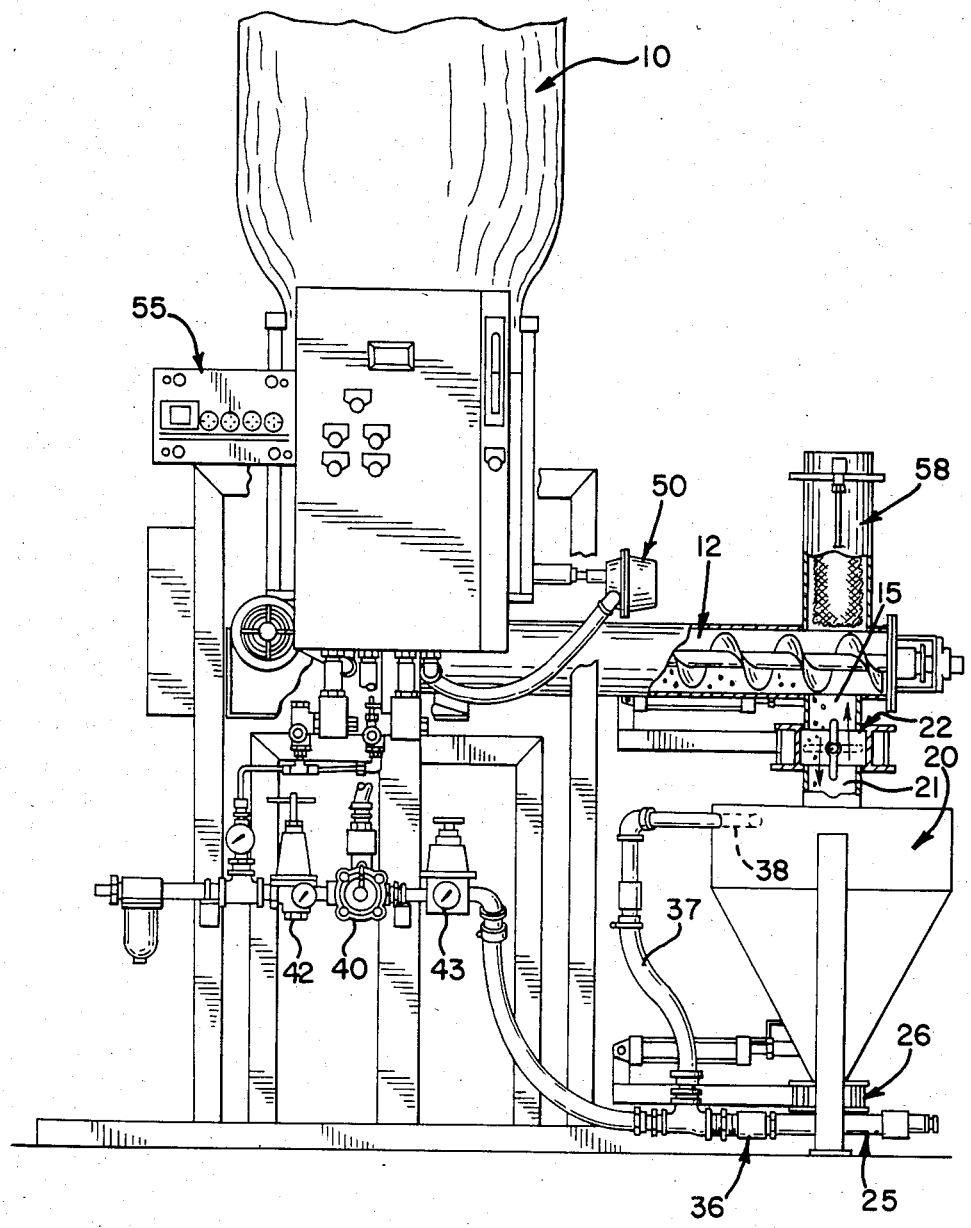
FIG. 1 is a front elevational view of the dry product feeding apparatus of the present invention with some parts in section and other parts broken away for purposes of clarity.
Figure 2:
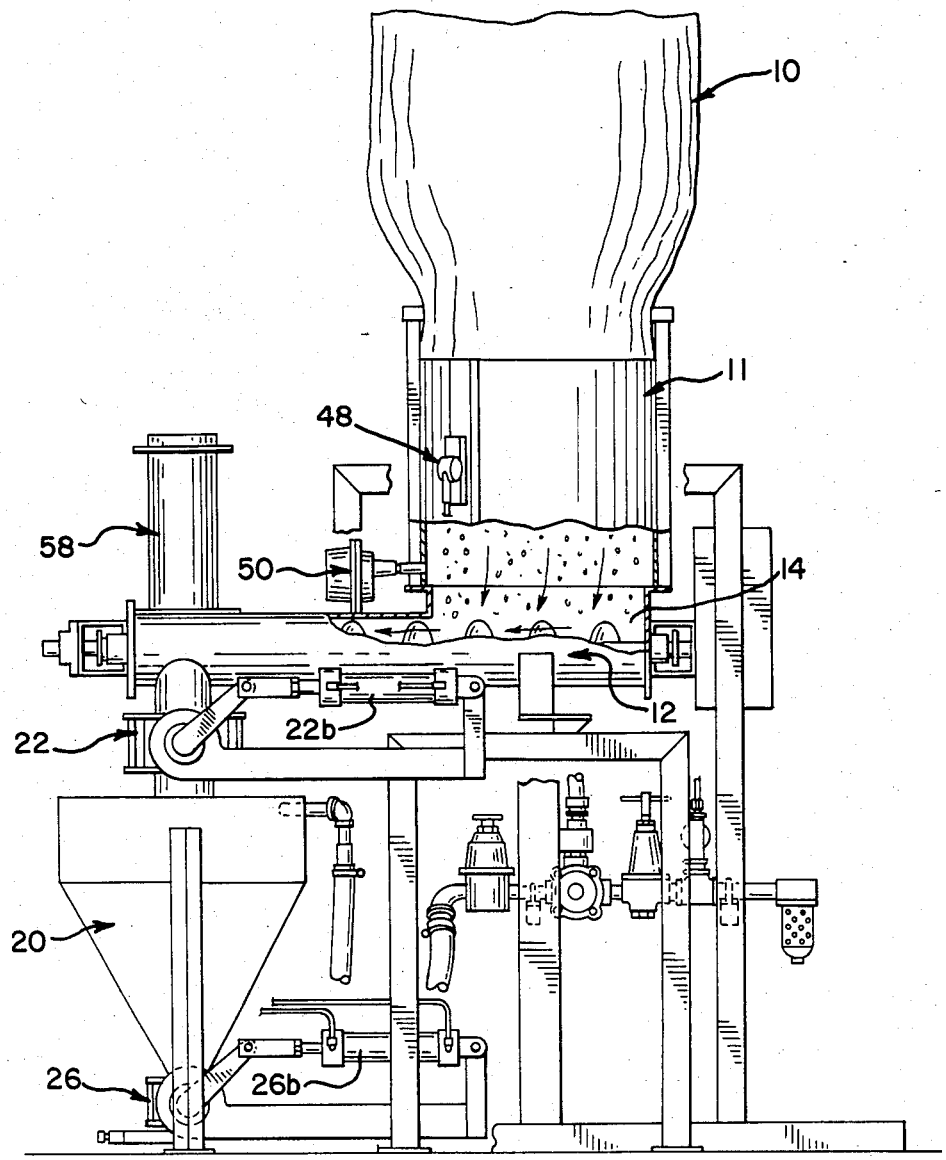
FIG. 2 is a rear elevational view of the apparatus of FIG. 1.
Figure 3:
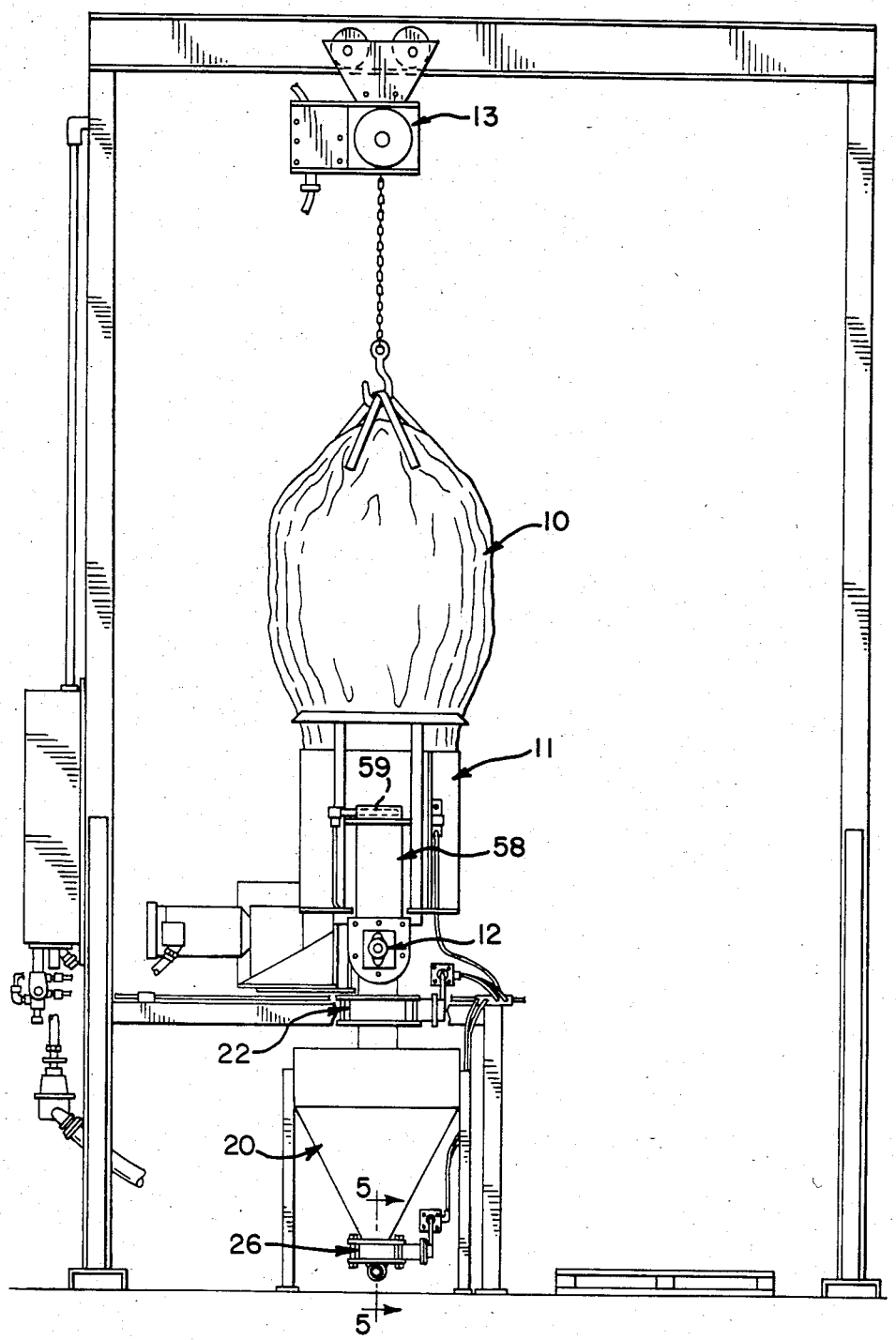
FIG. 3 is an end elevational view of the apparatus shown in FIGS. 1 and 2 and also illustrating structure for handling superbags of powdered material.
Figure 4:
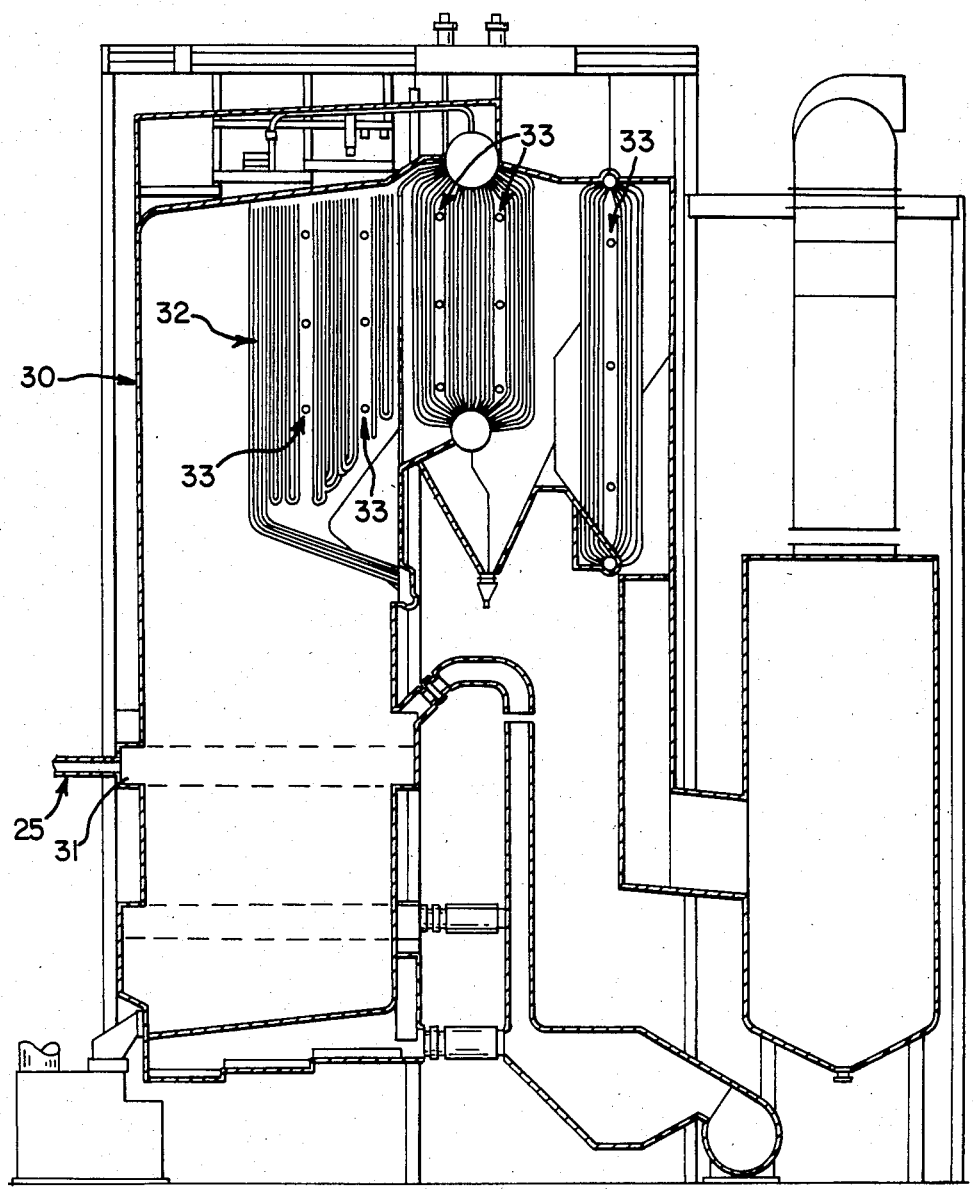
FIG. 4 is a vertical sectional view taken through a recovery boiler for a kraft pulp and paper mill which utilizes the apparatus of the invention to reduce sootblowing requirements.

Referring now to the drawings, and particularly to FIGS. 1, 2 and 3, the apparatus of the invention for cyclically feeding a measured amount of material to a furnace or boiler is illustrated and a representative type of boiler is shown in FIG. 4.

A supply of powdered material such as a slag control chemical is provided to the apparatus of the invention in a superbag 10 which is disposed over a hopper 11 supported in elevated fashion on suitable structural supports in association with a metering auger 12. It may be appreciated that the superbag will be of considerable weight, thereby necessitating a hoist 13 to raise it into position above the hopper. In the usual manner the superbag would be opened so that the contents then gravitationally fall into the hopper. As seen particularly in FIG. 2, the hopper 11 communicates with the inlet 14 to the metering auger at one end thereof, while an outlet 15 is provided at the other end of the auger, as seen particularly in FIG. 1.

A suitable motor is provided for driving the auger 12 which will move the powdered material from the inlet end to the outlet end during the time the motor is driving the auger.

Below the outlet end of the auger a low pressure vessel 20 is in communication with the outlet end of the auger in that the vessel 20 includes an inlet 21 in communication with the outlet 15 through a hopper butterfly valve 22. Thus, when the upper butterfly valve 22 is open as shown in solid lines in FIG. 1 and the auger is being driven, material from the hopper would be transferred to the pressure vessel 20.

Figure 5:
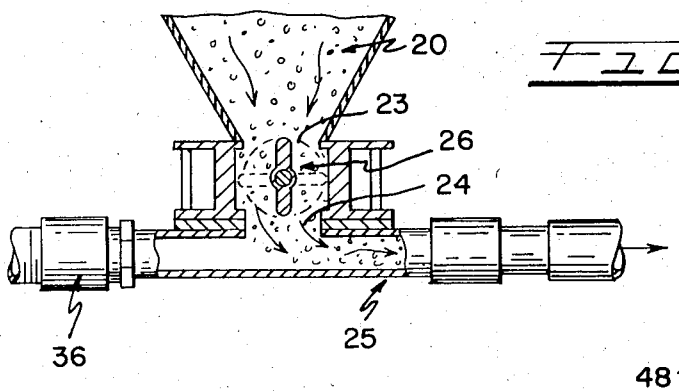
FIG. 5 is an enlarged vertical sectional view taken through a part of the pressure vessel and the air supply line to illustrate the manner in which the contents of the pressure vessel are transferred into the air supply line to the boiler.

The pressure vessel 20 includes an outlet 23, as seen in FIG. 5, in communication with an inlet 24 to an air supply line 25 through a lower butterfly valve 26. The air supply line 25 connects to the duct of a recovery furnace, as illustrated in FIG. 4, where the furnace 30 includes a duct structure 31 positioned above the fire and below the heat exchanger tubes 32. It may be appreciated that the heat exchanger tubes 32 may include the screen superheater and generating tubes and that the furnace 30 illustrates a kraft recovery furnace for use in a kraft pulp and paper mill. As above mentioned, the feeding apparatus of the present invention may be associated with any type of furnace where there is a need for treatment by the injection of a dry powdered product into the furnace. Upon injection of a slag control chemical into a furnace, the chemical is carried upwardly to coat the heat exchanger tubes 32. A plurality of banks 33 of soot blowers are appropriately provided among the heat exchanger tubes 32 for carrying on the sootblowing operations of the furnace.

The upper and lower butterfly valves 22 and 26 are of a suitable type that will prevent the passage of the powdered material when in closed position and will essentially open the passageway for free movement of powdered material when in open position. Moreover, the upper valve 22 is larger than the lower valve 26 to facilitate the charging of the vessel 20 with a measured amount of powdered material.

A check valve 36 is mounted in the air supply line 25 ahead of the material inlet 24 to charge the pressure vessel 20 with a low positive pressure when the air supply line is connected to a source of compressed air upstream or ahead of the check valve 36. The air supply line includes a bleed line or conduit 37 which is connected into the top of the vessel and which includes a nozzle 38 that is tangentially disposed relative to the inner wall to direct the air when the lower butterfly valve 26 is open in a circular fashion along the inner wall to assist in forcing the powdered material from the vessel and into the air supply line.

Figure 6:
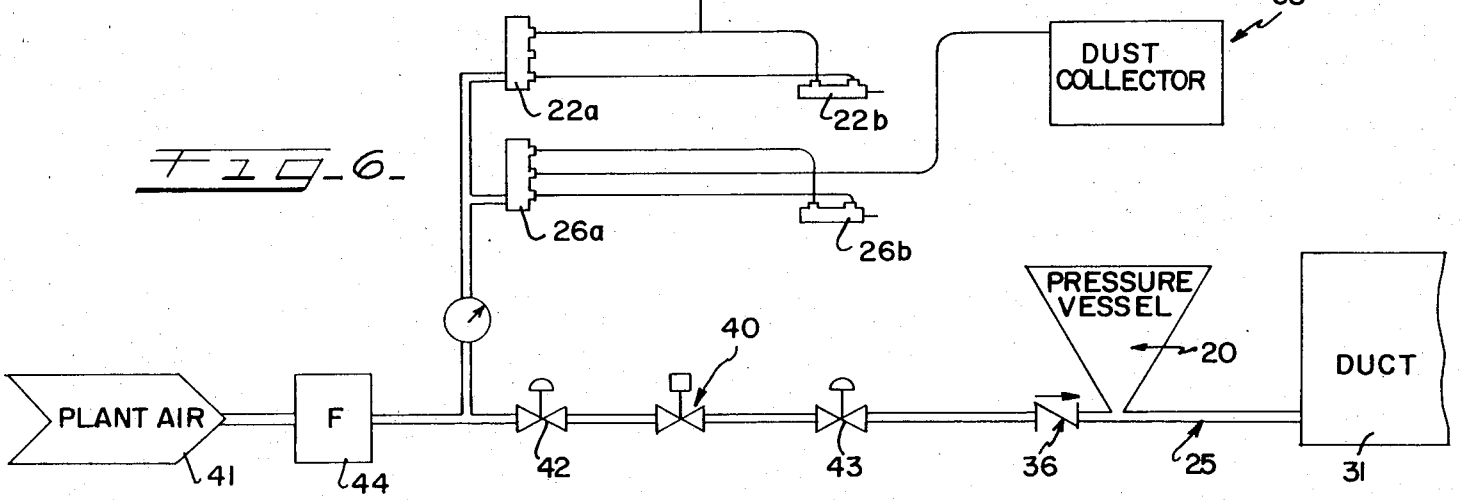
FIG. 6 is a schematic diagram of the pneumatic circuit for the feeding apparatus of the invention.

As seen particularly in FIGS. 1 and 6, a solenoid operated valve 40 selectively interconnects the air supply line 25 with the plant air supply 41. Pressure regulating valves 42 and 43 are provided on opposite sides of the solenoid valve 40 for controlling the pressure in the air supply line. A conventional air filter 44 is provided to filter the plant air. Additionally, as seen in FIG. 6, the plant air is supplied to three-way pneumatic control valves **22*a* and 26*a* which in turn are connected to pneumatic cylinders 22*b* and 26*b* for purposes of actuating the upper and lower butterfly valves 22 and 26**.

As seen particularly in FIG. 2, the piston rod of pneumatic actuator **22*b* is pivotally connected to an operating arm that drives the butterfly valve 22 between open and closed positions. Similarly, the piston rod of actuator 26*b* is pivotally connected to a control arm that is connected to the butterfly valve 26** for opening and closing.

In order to prevent bridging of any powdered material in the hopper 11, a pneumatic vibrator 48 is mounted on the side wall of the hopper and periodically energized whenever the upper butterfly valve 22 is actuated. A connecting line is illustrated in FIG. 6 between the pneumatic vibrator and one of the air supply lines to the pneumatic actuator **22*b*** of the upper butterfly valve.

A level probe 50 is mounted on the hopper 11 at the lower end which detects when the level of the powdered material therein is low to trigger a signal to the operator for indicating the need to remove the empty superbag and replace it with a full superbag of powdered material.

Figure 7:
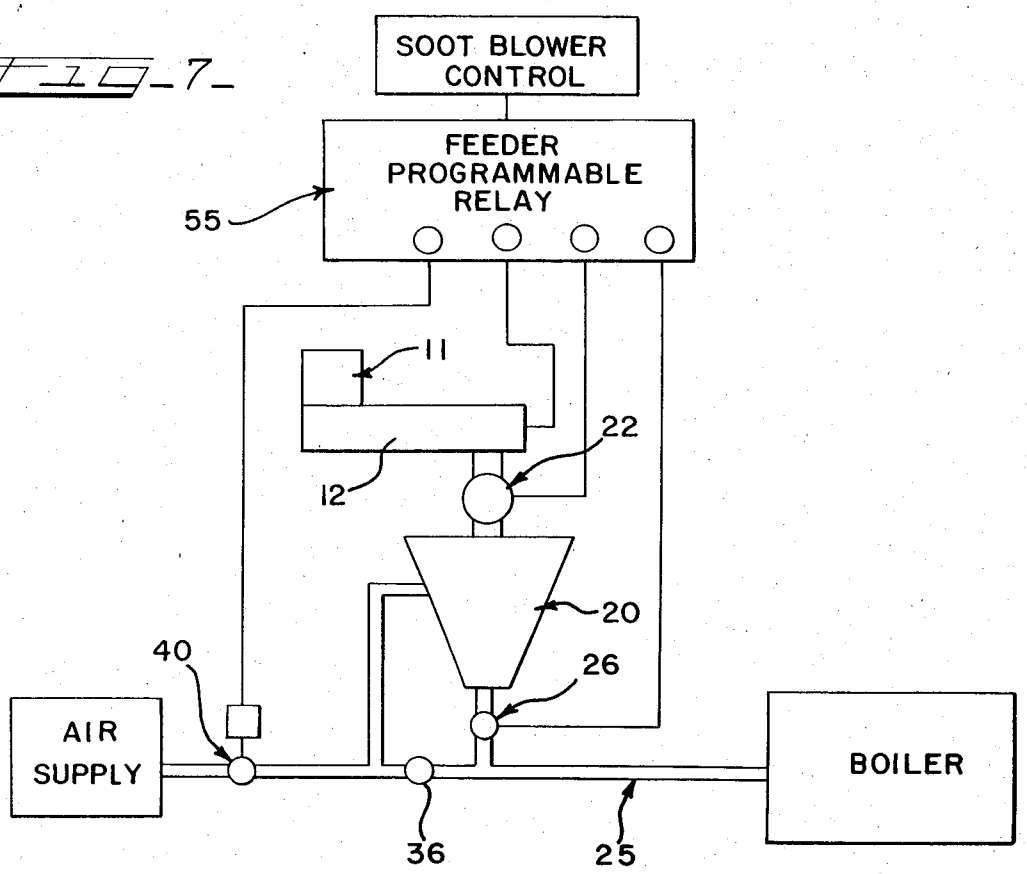
FIG. 7 is a schematic and block diagram of the electrical circuit employed for the present invention.

As already mentioned, the operation of the feeding apparatus of the invention is coordinated with the sootblowing cycles of the furnace inasmuch as it is desired to recoat the heat exchanger tubes following a sootblowing operation to provide a new cleavage plane which will inhibit deposit formation. As shown in FIGS. 1 and 7, a programmable relay 55 controls the operation of the feeding apparatus and particularly the pneumatic and electrically operated devices in the system. Upon receiving a signal from the soot blower control as to the termination of the sootblowing cycle, the feeding apparatus of the invention is cycled to commence feeding of a measured amount of powdered material to the furnace or boiler. The air is turned on to the air supply line 25 by opening of the air supply solenoid valve 40 and air is maintained in the line for about a minute to clear and dry the air supply line. After about a minute, the air stays on and the lower butterfly valve 26 is opened to commence discharging the powder from the low pressure vessel 20 and conveying it through the air supply line 25 to the duct in the boiler.

Because of the check valve 36, a positive pressure of a sufficient amount is established in the pressure vessel to assist in the discharge of the powdered material which also gravitationally discharges through the outlet of the vessel once the butterfly valve 26 is opened. It may also be appreciated that the air supply in the line 25 will further induce the powdered material to enter the line and be transferred to the boiler. The time set to empty the pressure vessel is adjusted to assure complete emptying of the vessel and is adjustable to correspond to the measured amount of material in the vessel. After the preset time expires, the lower valve 26 is closed and the air pressure is maintained in the air supply line for about another minute to make sure that the line is clear. Then the solenoid valve 40 closes to cut off the air supply to the air supply line 25. Also, a programmable relay 55 causes actuation of the pneumatic control and actuating means for the upper butterfly valve 22 to open it and allow a subsequent charging of the vessel with a measured amount of material. At the same time the valve 22 is opened, the auger 12 is turned on to feed powdered material from the hopper 11 to the discharge opening 15 of the auger conveyer. The time set for allowing the valve 22 to be opened and the auger 12 to operate determines the charge of material to the vessel 20. This can be adjusted to provide the desired amount of material in the vessel for a subsequent charging cycle of the boiler. When the preset time expires, the valve 22 closes and the auger 12 is turned off. As above mentioned, during the opening and/or closing of the butterfly valve 22, the pneumatic vibrator 48 on the hopper 11 is energized to assist in the discharge of powdered material from the hopper to the auger.

Since the pressure vessel 20 will be under a positive pressure condition immediately following the turning off of the air supply line solenoid valve 40, it is necessary to handle this pressure when opening the upper butterfly valve 22. This pressure is released upwardly through the upper butterfly valve and through a dust collector vent 58 positioned on the top of the auger housing and directly above the butterfly valve 22. The dust collector vent includes a fabric filter supported over a steel perforated frame. In order to self-clean the dust collector, a pneumatic line is connected from the discharge of the solenoid operator air control valve **26*a* which is connected to a nozzle 59** for emitting a puff of air internally of the fabric filter to knock loose the connected material and allow it to fall back into the auger housing. The cycle of operation for the feeder is then repeated following a subsequent signal of the completion of a sootblowing operation.

Once the feeder apparatus is set for conveying a measured amount of powdered material to a boiler, it is self-operating and requires attention only when the level of material in the hopper 11 is such as to trigger the level probe and indicate the need for replacing the empty superbag container with a full superbag container of powdered chemical. Otherwise, the feeder is programmed to operate automatically in relation to the sootblowing cycles of the boiler through the programmable relay 55.

It will be understood that modifications and variations may be effected without departing from the scope of the novel concepts of the present invention, but it is understood that this application is to be limited only by the scope of the appended claims.

We claim:

1. The method of operating a dry product feeding apparatus to periodically feed measured amounts of a dry product into a kraft recovery boiler in timed relation to a sootblowing cycle to coat the fireside surfaces of the sootblown heat exchanger tubes and establish a cleavage plane to inhibit deposit formation, wherein said apparatus includes a vessel having an inlet into which a measured amount of said product is fed by a metering device and an outlet connected to an air supply line, said air supply line being connected to an air supply upstream from the vessel and the boiler downstream from the vessel, a control valve in said line upstream from the vessel to selectively turn the air supply on and off, valves at said inlet and said outlet for controlling the passage of product into and out of said vessel, and a programmable relay for sequentially operating said air supply valve, said inlet and outlet valves and said metering device, said method comprising the steps of, opening the air supply valve to blow the air supply line clear, opening the outlet valve to allow the product to enter the air supply line and be blown into the boiler, closing the outlet valve and allowing the air supply to continue to blow the line clear, closing the air supply valve and opening the inlet valve, turning on the metering device and charging the vessel with a subsequent measured amount of product, and turning off the metering device and closing said inlet valve.

2. The method of automatically operating a dry product feeding apparatus to periodically feed measured amounts of a dry product into a boiler in timed relation to one or more selected sootblowing operations for said boiler to coat the fireside surfaces of sootblown heat exchanger tubes and establish a cleavage plane to inhibit deposit formation thereon, wherein said apparatus includes means for pneumatically conveying a measured amount of said product to said boiler in direct response to the completion of and immediately following said selected sootblowing operations, said method comprising the steps of, continually sensing the completion of one or more selected sootblowing operations, continually activating said pneumatic conveying means in response to the sensed completion of and immediately following said one or more selected sootblowing operations to feed said measured amount of product to said boiler for coating said sootblown tubes.

3. The method of automatically operating a dry product feeding apparatus to periodically feed measured amounts of a dry product into a boiler in timed relation to at least one sootblowing operation of said boiler to coat the fireside surfaces of sootblown heat exchanger tubes and establish a cleavage plane to inhibit deposit formation thereon, wherein said apparatus includes a vessel into which a measured amount of said product is fed by a metering device, and means for pneumatically conveying said product from the vessel to the boiler directly following a sootblowing operation, said method comprising the steps of, sensing the completion of a sootblowing operation of heat exchanger tubes, immediately activating said pneumatic conveying means to feed a measured amount of said product from the vessel to said boiler to coat said sootblown tubes directly in response to the sensed completion of the sootblowing operation, and activating the metering device and charging the vessel with a subsequent measured amount of product for a subsequent feeding operation following a subsequent sootblowing operation.

* * * * *

UNITED STATES PATENT AND TRADEMARK OFFICE

CERTIFICATE OF CORRECTION

PATENT NO. : 4,639,381

DATED : January 27, 1987

INVENTOR(S) : Robert B. Wierzba, et al.

It is certified that error appears in the above-identified patent and that said Letters Patent are hereby corrected as shown below:

Col. 2, line 6, after "controlling" insert --kraft recovery--.

Signed and Sealed this

Twenty-first Day of April, 1987

*Attest:*

DONALD J. QUIGG

*Attesting Officer*

*Commissioner of Patents and Trademarks*